US006771928B2

(12) United States Patent
Fujita

(10) Patent No.: US 6,771,928 B2
(45) Date of Patent: Aug. 3, 2004

(54) IMAGE FORMING APPARATUS WITH CONTROL FOR VARYING CONVEYING SPEED BETWEEN A REGISTRATION SECTION AND A DECELERATING POSITION

(75) Inventor: Takashi Fujita, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/322,452

(22) Filed: Dec. 19, 2002

(65) Prior Publication Data

US 2003/0113150 A1 Jun. 19, 2003

(30) Foreign Application Priority Data

Dec. 19, 2001 (JP) ..... 2001-386241

(51) Int. Cl.[7] ..... G03G 15/00
(52) U.S. Cl. ..... 399/394; 399/396
(58) Field of Search ..... 399/394, 396, 399/391, 401, 38, 43, 45, 66; 271/242, 9.01

(56) References Cited

U.S. PATENT DOCUMENTS 5,119,146 A * 6/1992 Nobumori et al. ..... 399/396
6,529,703 B2 * 3/2003 Kawasumi et al. ..... 399/396 X
2002/0150407 A1 * 10/2002 Ishiwata ..... 399/394 X

FOREIGN PATENT DOCUMENTS

| | | | |
|---|---|---|---|
| JP | 09-244316 | * | 9/1997 |
| JP | 2002-154715 | * | 5/2002 |
| JP | 2002-156802 | * | 5/2002 |
| JP | 2002-255401 | * | 9/2002 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus forms a latent image on the basis of a signal outputted at a constant time interval, and develops the latent image on a sheet in an image forming section. A resist roller pair arranged upstream of the image forming section and able to change a conveying speed re-feeds the sheet after the sheet is stopped for a predetermined time. A controller starts the conveyance of the sheet at a speed higher than an image forming speed, controls the speed of the resist roller pair so as to be equal to the image forming speed at a position before a predetermined distance from the image forming section and sets the conveying speed at a high speed conveying time in the resist roller pair so as to be equal to the image forming speed at the position before the predetermined distance from the image forming section.

10 Claims, 4 Drawing Sheets

IMAGE FORMING APPARATUS WITH CONTROL FOR VARYING CONVEYING SPEED BETWEEN A REGISTRATION SECTION AND A DECELERATING POSITION

BACKGROUND OF THE INVENTION

1. Field of the Invention

The present invention relates to an image forming apparatus such as a printer, a facsimile telegraph, a copying machine, or a composite machine combining and having these functions, etc.

2. Description of the Related Art

For example, the image forming apparatus such as a copying machine, a printer, a facsimile telegraph, etc. widely uses a apparatus for fixing an unfixed toner image formed and carried in accordance with image information of an object in a transfer system (indirect system) or a direct system to a recorded material (a paper sheet member such as a transfer material, photosensitive paper, electrostatic recording paper, printing paper, etc.) as a sheet by a suitable image making process mechanism such as an electro-photographic system, an electrostatic recording system, a magnetic recording system, etc.

Further, an apparatus for directly forming the image on the sheet by a liquid including dyes and a pigment as in an ink jet system, etc. is also used.

In such apparatuses, the sheet fed by a sheet feed section one by one from a sheet support section (paper feed cassette) once hits against the nip of a stopped resist roller pair adjacent to the sheet conveyance upper stream of an image forming section.

In this case, the sheet tip is detected by a sheet detecting sensor arranged in the vicinity of the upper stream of the resist roller pair. After the sheet tip hits against the resist roller pair, the operation of a conveying roller arranged on the upper stream of the resist roller pair is generally stopped in predetermined timing for feeding the sheet by 5 to 15 mm.

Accordingly, an oblique movement correction is made by arranging the sheet tip in parallel with a nip line of the resist roller pair by rigidity of the sheet.

Thereafter, the positions of the sheet and the image are aligned with each other by operating the resist roller pair in synchronization with the image formed in the image forming section, and forming the image on the conveyed sheet. The circumferential speed of the resist roller pair is set to be approximately equal to an image forming speed.

The mainstream of the sheet detecting sensor is constructed by a sensor formed by combining a rotational lever biased by a spring in one direction and a transmission type photo-interrupter constructed by oppositely arranging a light emitting element and a light receiving element. This sensor detects the existence or nonexistence of the sheet by interrupting and uninterrupting the light of the transmission type photo-interrupter by the lever when the lever is thrown down by the sheet. The mainstream of the sheet detecting sensor is also constructed by a reflection type photo-interrupter for irradiating light from a light emitting element to the sheet and directly detecting reflected light and diffused light by a light receiving element.

Further, there is a structure having a striking plate able to be selectively shunted at a position before a conveying roller arranged on this side of the image forming section without arranging the resist roller pair. In this structure, a sheet detecting sensor similar to the above sheet detecting sensor is arranged in the upper stream of the striking plate, and the operation of the conveying roller in the upper stream of the striking plate is stopped in predetermined timing from a detecting signal of this sheet detecting sensor.

In this structure, similar to the resist roller pair, the oblique movement correction is made by arranging the sheet tip in parallel with the striking plate, and the positions of the sheet and the image are aligned with each other by shunting the striking plate in synchronization with the image formed by the image forming section.

In the image forming apparatus represented by the facsimile telegraph, the printer and the copying machine, digitalization is advanced in recent years. For example, the copying machine of the electro-photographic system uses a system in which the reflected light of illumination of a reader section is read by a photoelectric element such as CCD, etc., and is A/D converted, and a laser beam is emitted. In this system, the image is written to a photosensitive member by scanning the laser beam in the direction of a bus line of the photosensitive body by rotating a polygon mirror, and is also written to the photosensitive member by LEDs arranged at a small pitch. An ink jet system for forming the image by directly ejecting an ink droplet to the sheet is also used. Further, a heat-sensitive recording system is further used.

However, when the above digitalization is advanced, the number of technical problems is increased and cost of the solution of these technical problems is increased as e.g., the number of rotations of the polygon mirror, and the driving frequencies of an LED head and an ink jet head are raised.

Further, it is desirable to energetically reduce the image forming speed as much as possible in view of the durability of all parts moved or rotated.

Accordingly, it is also desired to increase productivity by narrowing the sheet interval as much as possible in a structure having the same image forming speed.

However, when the sheet interval is narrowed, the problem of shortening of a back scan time in the reader section is caused in e.g., the copying machine. There is a method for arranging a memory on the entire face of the image able to be read by one reader scan as one of methods for solving such a problem.

In accordance with this construction, the sheet interval can be narrowed since the time of the back scan of the reader section can be omitted by repeatedly discharging the image read once from the memory.

The memory was previously expensive, but its cost is remarkably reduced in recent years. A memory, a hard disk, etc. having a means for storing the image and mounted to a main body are sold.

Accordingly, a factor for determining the sheet interval is determined by sheet conveying performance of the image forming apparatus. This factor is similarly determined by the sheet conveying performance in the printer and the facsimile telegraph.

Accordingly, when it is intended that the conveying interval of the sheet is narrowed, the condition of a minimum sheet conveying interval is that the sheet can be detected by the sheet detecting sensor in the upper stream of the resist roller pair. Accordingly, the amount (since no sheet is advanced at this time) provided by adding an inter-sheet minimum detecting interval of the sheet detecting sensor and a feed-in amount (hereinafter called a loop amount) in making the oblique movement correction of the sheet as mentioned above becomes the minimum sheet conveying interval except for small defects such as a detecting error, etc.

Further, when an electromagnetic clutch is used in e.g., drive coupling in the driving construction of the resist roller pair, and the dispersion of a coupling time of the electromagnetic clutch is set to 30 msec, (30 msec)×(a sheet interval margin corresponding to a conveying speed) must be added to the above minimum sheet conveying interval. Further, when the resist roller pair is operated by a pulse motor, a starting up time and its loss time must be added to the minimum sheet conveying interval although the dispersion is small.

SUMMARY OF THE INVENTION

In consideration of the above problems, an object of the present invention is to provide an image forming apparatus able to improve productivity by minimizing the interval of a conveyed sheet without increasing cost.

The present invention is characterized in an image forming apparatus comprising an image forming section for forming a latent image on the basis of a signal outputted at a constant time interval, and forming the image on a sheet by developing the latent image; a registration section arranged on the upstream side of the image forming section, and able to change a conveying speed for re-feeding the sheet after the sheet is stopped for a predetermined time; and a control section for starting the conveyance of the sheet re-fed by the registration section where a speed higher than an image forming speed in the image forming section, and controlling the conveying speed so as to be equal to the image forming speed at a position before a predetermined distance from the image forming section; wherein the control section sets the conveying speed at a high speed conveying time in the registration section so as to be equal to the image forming speed at the position before the predetermined distance from the image forming section.

DESCRIPTION OF THE PREFERRED EMBODIMENT

An image forming apparatus using the present invention will next be explained with reference to the drawings. An embodiment mode of the present invention will be explained by using a copying machine adopting an electrophotographic system as the image forming apparatus.

Figure 1:
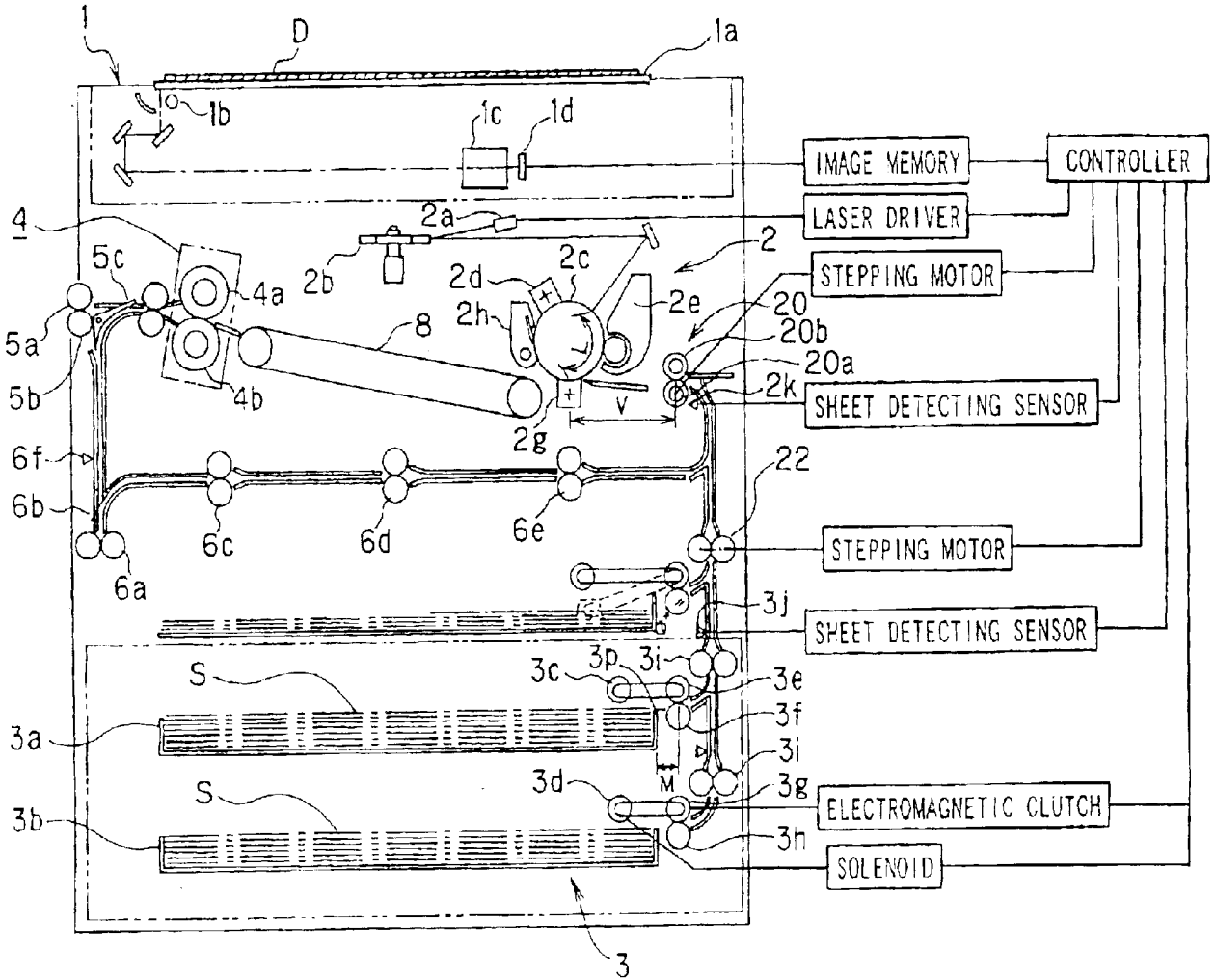
FIG. 1 is a sectional view showing an entire image forming apparatus of the present invention.

FIG. 1 is a sectional view showing the schematic construction of the copying machine in this embodiment mode.

The schematic construction of the copying machine will first be explained with reference to FIG. 1. In the copying machine, image information read by a reader section 1 having a scanning optical system is photo-electrically converted and is transferred to an image forming section 2. An image is formed on a sheet S fed by a paper feed section 3 in the image forming section 2.

After the image formation, the sheet S is conveyed to a fixing device 4 and heat and pressure are applied to the sheet S so that the transfer image is fixed to the sheet S. Since a series of electro-photographic processes is publicly known, its detailed explanation is omitted.

(Reader Section)

Light is irradiated to an original D placed on an original base glass 1*a* by the scanning optical system 1*b* having a light source and a reflecting mirror group. Its reflected light is focused and formed as an image on a CCD 1*d* through a reducing lens 1*c*, and is photo-electrically converted and is A/D converted. Thereafter, this image information is transferred to an image memory.

A maximum original size is set to LTR or A3. In this embodiment mode, the copying machine is constructed such that a double-faced copy can be made. Accordingly, the image forming apparatus has an image memory twice the maximum original size.

(Paper Feed Section)

Paper feed cassettes 3*a*, 3*b* as a sheet support section for stacking and storing the sheets S of different sizes are detachably mounted to the lower portion of the copying machine. The sheets S stored in the paper feed cassettes 3*a*, 3*b* are sent out by pickup rollers 3*c*, 3*d*. The sheets S are separated one by one by a separating section constructed by conveying rollers 3*e*, 3*g* and retard rollers 3*f*, 3*h*, and are sent to a pull-out roller pair 3*i*. A sheet feed section is constructed by the pickup rollers 3*c*, 3*d*, the conveying rollers 3*e*, 3*g* and the retard rollers 3*f*, 3*h*.

One separated sheet S is sent to the image forming section 2 through the pull-out roller pair 3*i*, the conveying roller pair 22 and a resist roller pair 20 as a registration section.

The resist roller pair 20 is constructed by biasing a driven roller 20*b* against a drive roller 20*a* by an unillustrated spring.

The drive roller 20*a* of the resist roller pair 20 is constructed by fixing rubber to the outer circumference of a metallic core bar. The driven roller 20*b* is constructed by a metal having a small surface roughness of the outer circumference. As shown in FIG. 1, the drive roller 20*a* is operated by a stepping motor, and its rotating speed can be controlled by the controller of a main body.

(Image Forming Section)

A laser light emitting portion 2*a* emits a laser beam by a laser driver on the basis of the image information read by the reader section 1, and a polygon mirror 2*b* scans the laser beam in the bus line direction of a photosensitive drum 2*c* by rotating. The laser beam scanned in the bus line direction of a photosensitive drum 2*c* forms a latent image on the drum face of the photosensitive drum 2*c* charged by a charger 2*d* in advance.

This latent image is developed into a toner image by a developing device 2*e* arranged around the photosensitive drum 2*c*, and the toner image is transferred to the sheet S conveyed by the resist roller pair 20 by a transfer charger 2*g*. After the toner image transfer, the toner left on the drum face of the photosensitive drum 2*c* is removed by a cleaner 2*h*.

Figure 3:
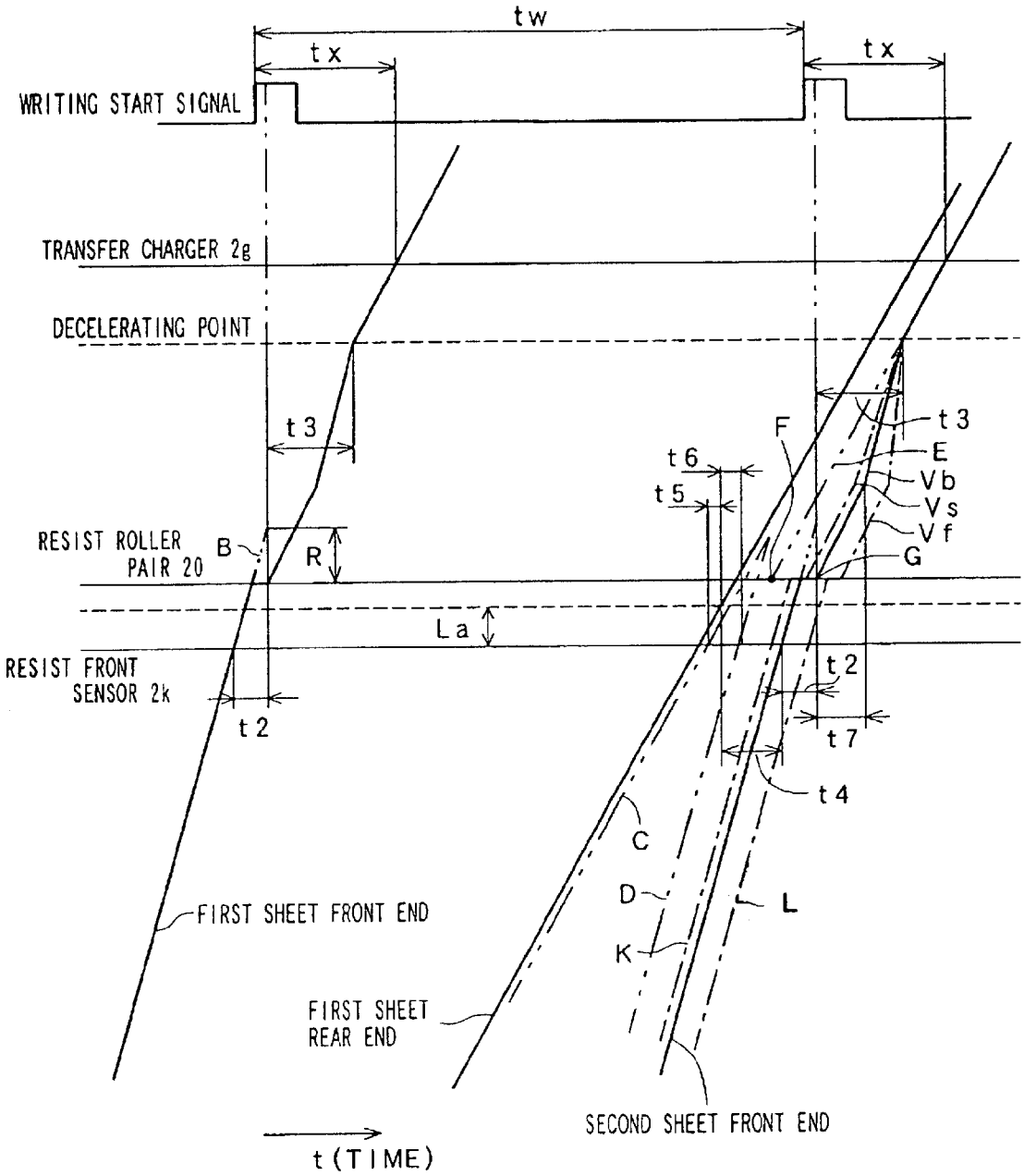
FIG. 3 is a diagram showing a conveying position near a resist roller pair in the present invention.

The timing of the formation (writing) of the latent image onto the drum face of the photosensitive drum 2*c* is set to a time (tw) of a constant interval, and the latent image is formed on the photosensitive drum 2*c* by outputting a writing start signal from the controller every time tw (see FIG. 3).

The conveyance of the sheet S is then started by turning-on the operation of the resist roller pair 20 on the basis of timing for forming the latent image.

The time from the output of the writing signal from the controller until the formed latent image is developed by the developing device 2*e* and reaches the transfer charger 2*g*, is set to tx and is constant.

The sheet S to which the toner image is transferred in the image forming section 2 is conveyed on a conveying belt 8 and is guided to the fixing device 4. When the sheet S passes through the roller pair of fixing rollers 4*a*, 4*b* within the fixing device 4, heat and pressure are applied to the sheet S so that the toner image is melted and attached to the sheet S.

After the image fixation, the sheet S is discharged outside the apparatus through a pair of discharge rollers 5*a*, 5*b*.

When it is desirous to form the image on both faces of the sheet S, the sheet S in which the image on its first face is formed is again conveyed to the image forming section 2 by a double-faced conveying section described later.

(Double-Faced Conveying Section)

When a double-faced copy is made, the sheet S after the image fixation is guided to an inverted roller pair 6*a* by operating a flapper 5*c* by an unillustrated actuator, and reaches the inverted roller pair 6*a* while the sheet S knocks down a flexible sheet 6*b*.

The inverted roller pair 6*a* is a roller pair able to be rotated in the normal and reverse directions. The inverted roller pair 6*a* sends the sheet S downward by the normal rotation. The rear end of the sheet S is detected by a detecting sensor 6*f*. After the sheet S passes through the flexible sheet 6*b*, the inverted roller pair 6*a* is reversely rotated and sends the sheet S upward. The sheet S sent upward by the inverted roller pair 6*a* reversely rotated, is guided to the side of a conveying roller pair 6*c* by the flexible sheet 6*b* without causing a reverse flow.

The sheet S passes through conveying roller pairs 6*d*, 6*e*, and again reaches the resist roller pair 20. The image of a second face is written to the sheet S at this time by control similar to that on the first face, and is fixed by the fixing device 4, and is then discharged to the exterior of the apparatus.

Since the image memory of two sheets is arranged in this embodiment mode, the double-faced copy can be also endlessly made in the formation of a continuous image until a stack number of the sheets S by alternately writing the images of the first and second faces.

(Sheet Conveying Operation)

The conveying operation of the sheet S from the upper stage paper feed cassette 3*a* will next be explained.

Figure 2:
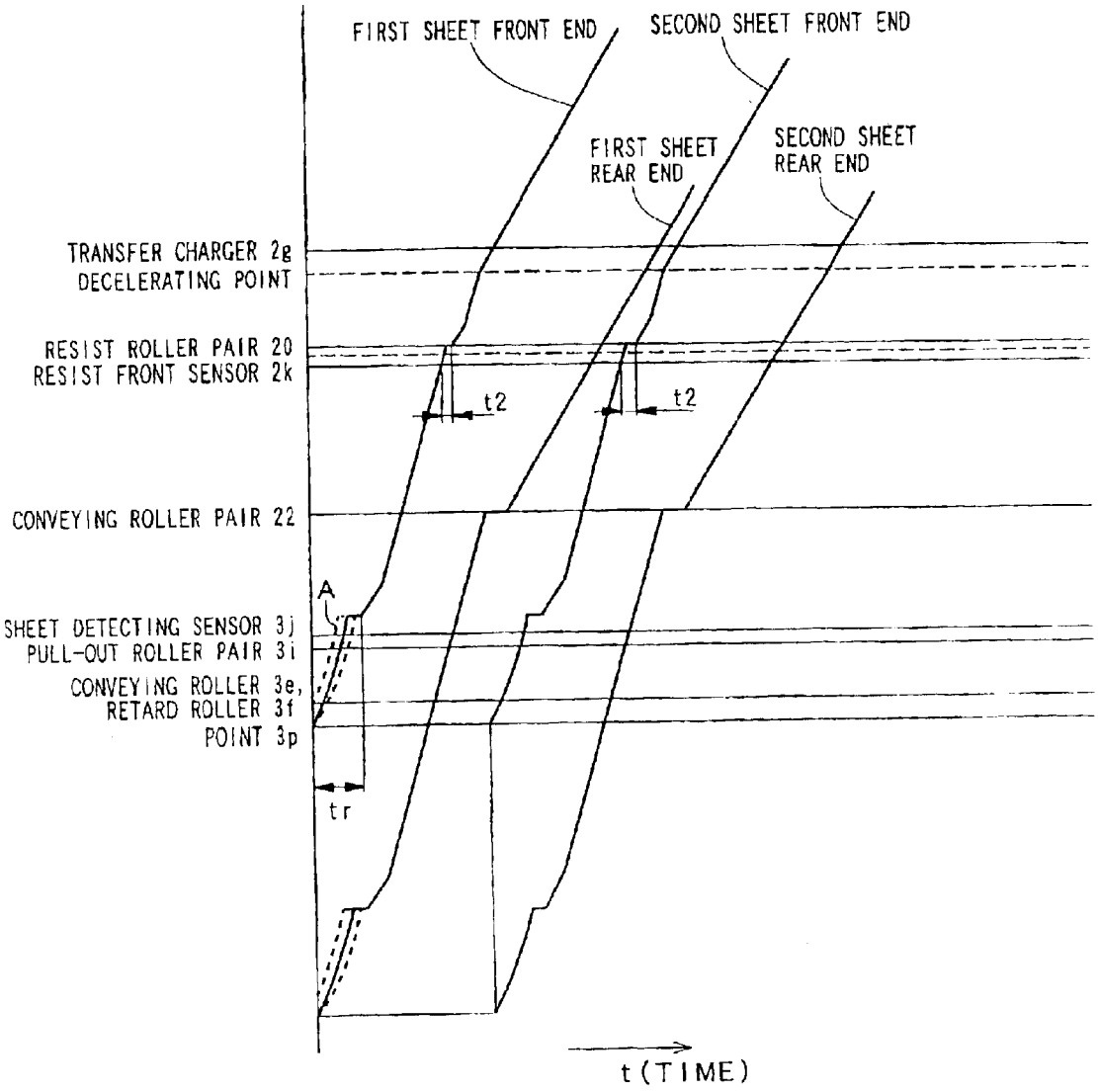
FIG. 2 is a diagram showing a conveying position with respect to time at sheet front and rear ends in the present invention.

FIG. 2 is a diagram showing the conveying position with respect to time at the sheet front and rear ends in this embodiment mode. The axis of abscissa is set to time, and the axis of ordinate is set to distance. Accordingly, the inclination of a line shows a conveying speed. The paper feed and conveying operations are controlled by the controller as a control section shown in FIG. 1.

The sheet S is fed one by one by the pickup roller 3*c* rotated by turning on/off a solenoid connected to the pickup roller 3*c* at a constant interval. If plural sheets S are picked up and are nipped and supported by the conveying roller 3*e* and the retard roller 3*f*, the sheets S except for one sheet on the uppermost side are conveyed in the reverse direction by the retard roller 3*f* operated in the direction reverse to the conveying direction through an unillustrated torque limiter so that the sheet S as only one sheet on the uppermost side is fed.

However, the sheet interval is not constant, but is dispersed by a momentary slip at a pickup time and the instability of a conveying speed in the conveying roller 3*e* and the retard roller 3*f* (there are many cases in which the sheet conveying speed is slower than the rotating speed of the roller since a soft rubber roller of 25° is used and reverse rotating force is applied to the sheet S) even when the pickup operation is repeated at a constant interval.

Further, the dispersion of the position of the sheet tip at the pickup time from a point 3*p* to the separating section (during an interval M) is also a factor of the dispersion of the sheet interval. In FIG. 2, a dotted line portion shows a diagram showing a conveyance delay, and an A-line shows a diagram showing that the sheet S is started from the separating section.

When such dispersion is left in the resist roller pair 20, the sheet conveying interval must be set in consideration of the dispersion amount to detect the sheet s so that such dispersion becomes a factor of a reduction in productivity. In this embodiment mode, the following control is performed to remove this dispersion of the paper feed section before the resist roller pair 20.

When the sheet S is detected by a sheet detecting sensor 3*j* adjacent to the pull-out roller pair 3*i* at a position after the separating section, the sheet S is once stopped by disconnecting the transmission of the operations of the pull-out roller pair 3*i* and the conveying roller 3*e*, the retard roller 3*f* and the pickup roller 3*c*.

Next, the operations of the pull-out roller pair 3*i* and the conveying roller 3*e*, the retard roller 3*f*, and the pickup roller 3*c* are again started by uniformly waiting for a maximum allowance time (tr) of the delay from the pickup.

Here, the conveying roller 3*e*, the retard roller 3*f*, the pickup roller 3*c* and the pull-out roller pair 3*i* are operated by the unillustrated same pulse motor, and an unillustrated electromagnetic clutch for connecting these operations is arranged on the axis of the conveying roller 3*e*.

The pull-out roller pair 3*i* is constructed by a rubber roller of 60° in hardness, and an opposed roller is a driven roller of resin. Therefore, the conveying speed is stabilized when the sheet S is nipped and supported by the pull-out roller pair 3*i*. Accordingly, with respect to the sheet S again conveyed, a time reaching the resist roller pair 20 is constant and the sheet interval is also constant.

In this embodiment mode, 60 cpm (at an LTR size) is set at an image forming speed V1 of 250 mm/s, and the conveying speed of the paper feed section (conveying roller 3*e*, retard roller 3*f*, pickup roller 3*c*, and pull-out roller pair 3*i*) is set to 500 mm/s with respect to a sheet interval of 34 mm in the image forming section 2. Accordingly, the sheet interval is widened to 184 mm at a position before the resist roller pair 20.

Further, the distance from the point 3*p* to the sheet detecting sensor 3*j* is set to 80 mm, and is allowed until a reduction in 30% of this distance with respect to the conveying speed of 500 mm/s. Accordingly, when no sheet S is detected even when a time of 229 msec has passed from the pickup, this state is judged as a jam, and the operation of the apparatus is stopped.

The next reconveyed sheet S passes through a resist front sensor 2*k* and then reaches the resist roller pair 20.

The resist roller pair 20 is stopped when the tip of the sheet S hits against the resist roller pair 20. The resist roller pair 20 is operated at a high speed of V2 in predetermined timing t2 after the tip of the sheet S is detected by the resist front sensor 2*k*.

FIG. 3 is an enlarged diagram showing the position of the sheet S around the resist roller pair 20. A two-dotted chain line B shows a moving diagram to be sent by the conveying roller pair 22. Therefore, a distance R is a pushing-in amount of the sheet S provided by the conveying roller pair 22 at the stopping time of the resist roller pair 20.

An oblique movement is corrected by arranging the resist roller pair 20 in parallel with the tip of the sheet S by the rigidity of the sheet S provided by this pushing-in amount.

The conveying speed of the resist roller pair 20 is decelerated to the same 250 mm/s as the image forming speed in predetermined timing t3 after the sheet S corrected in the oblique movement is conveyed by the resist roller pair 20.

In this case, since the sheet S is also bitten into the conveying roller pair 22, the conveying roller pair 22 is similarly decelerated to 250 mm/s. The conveying roller pair 22 is operated by a stepping motor different from the stepping motor used in the resist roller pair 20, and its rotating speed can be also controlled by the controller.

Figure 4A:
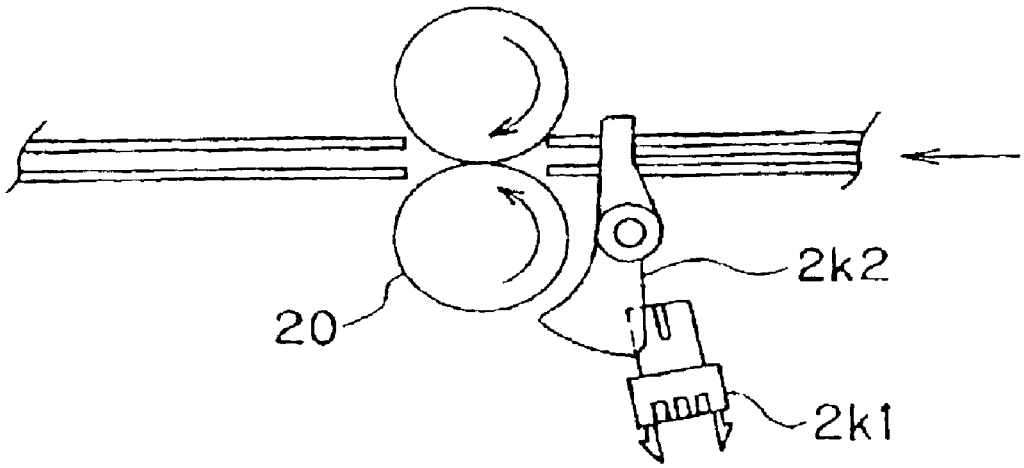
FIGS. 4A and 4B is a view showing a sheet detecting sensor.
Figure 4B:
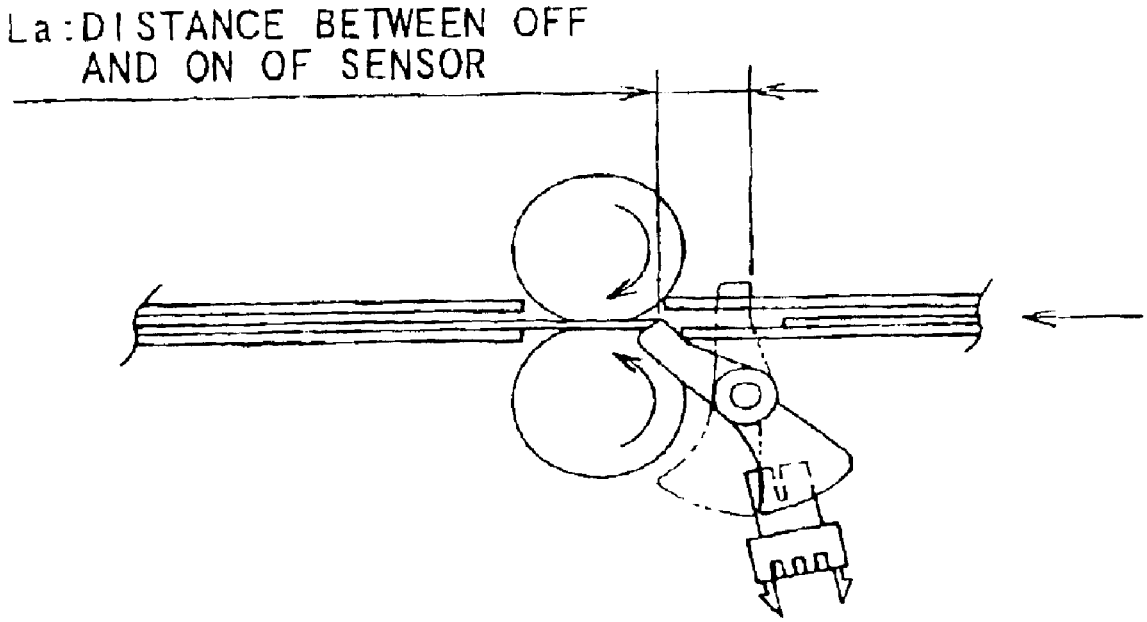

A time able to detect the front and rear ends of the sheet S by the resist sensor 2*k* is secured at a position before the resist roller pair 20 providing a narrowest sheet interval by the above control. In the resist sensor 2*k*, no lever 2*k*2 normally interrupts a photo-interrupter 2*k*1 as shown in FIG. 4A. However, the resist sensor 2*k* is constructed such that the lever 2*k*2 interrupts the photo-interrupter 2*k*1 when the sheet S is located as shown by a solid line of FIG. 4B, and the lever 2*k*2 is escaped from the interrupting position of the photo-interrupter 2*k*1 by the biasing force of an unillustrated spring as shown by a broken line of FIG. 4B when the sheet S passes through the resist sensor 2*k*.

Accordingly, when the sheet interval is shorter than the distance La between the turning on and off operations of the sensor, no sheet can be detected. For example, a two-dotted chain line C of FIG. 3 shows the next sheet tip when the pushing-in amount is set to the same and the feed speed is set to the same as the image forming speed. When the rear end of a first sheet S has passed through the resist front sensor 2*k*, a second sheet S reaches the resist front sensor 2*k* by an amount of t5 so that no front and rear ends of the sheet S can be detected and no resist roller pair 20 can be operated.

A two-dotted chain line D shows a case in which the sheet is conveyed at 500 mm/s until the resist roller pair 20, and the conveying speed of the resist roller pair 20 is constantly set to the same as the image forming speed. In this case, the resist front sensor 2*k* can detect the sheet S at an interval of t6, but margin is small and a detection defect is easily caused.

In this embodiment mode, since the conveying speed of the resist roller pair 20 is set to a speed (high speed) higher than the image forming speed by an amount of t3, the sheet detectable interval can be widened until t4.

As mentioned above, the timing of the formation (writing) of the latent image to the drum face of the photosensitive drum 2*c* is set to a constant interval (tw), and the time until the written latent image reaches the transfer charger 2*g*, is set to tx and is constant. The operation of the resist roller pair 20 is turned on and the conveyance of the sheet S is started on the basis of timing for forming the latent image.

It is necessary to set the conveying speed required at its minimum to a speed for setting a starting point G of the operation of the resist roller pair 20 to be slower than an intersection point F of the position of the resist roller pair 20 and a two-dotted chain line E (hereinafter called an image forming line E) provided by extending a line at the image forming time, and returning the sheet S to the image forming line E between the resist roller pair 20 and a decelerating point. Namely, when the sheet S early arrives at the resist roller pair 20 or is delayed and the sheet S is again fed by correcting the oblique movement by the resist roller pair 20, the conveying speed of the sheet S is set to a high speed Vb so as to be conformed to the image forming line E at the decelerating point.

In this embodiment mode, since the writing signal of the image must be outputted before the start of resist roller pair 20, the image position with respect to the sheet S is shifted when the sheet S is conveyed in conveyance timing synchronized with the image. The sheet S reaching the resist roller pair 20 is conveyed at a constant interval while the dispersion is restrained as mentioned above. However, small dispersions such as a roller outside diameter error, a rotation error, a clutch coupling dispersion, etc. are still left, and cause the sheet S early arrival at the resist roller pair 20 or delay. When the conveying speed of the resist roller pair 20 is constant, the resist roller pair 20 must be constantly started in conformity with the image writing signal. Therefore, the above dispersion becomes the dispersion of a loop amount so that the oblique movement correction is insufficient and the sheet S is folded. Therefore, the following control is performed to conform the positions of the image and the sheet S while the loop amount is constantly held.

In FIG. 3, a one-dotted chain line K shows a case in which the second sheet S early arrives at the resist roller pair 20. In this case, when the sheet S is again fed by the resist roller pair 20, the sheet S is conveyed that a speed of Vs slower than the reference speed Vb.

A one-dotted chain line L shows a case in which the second sheet S is delayed. In this case, when the sheet S is again fed by the resist roller pair 20, the sheet S is conveyed that a speed of Vf faster than the reference speed Vb.

Reference numeral t7 in FIG. 3 designates a starting up time until the stepping motor becomes a predetermined rotating speed.

In the copying machine for performing the writing operation to the photosensitive drum 2*c* at a constant interval, the image can be properly formed by setting such a conveying speed even when the sheet S for forming the image early arrives or is delayed.

Further, loss at the starting up time of the stepping motor can be canceled. Namely, the conveying speed Vb is set by estimating the starting up time t7 of the stepping motor.

Further, when the electromagnetic clutch is used in e.g., driving coupling by the driving construction of the resist roller pair 20, the coupling time of the clutch is dispersed, but the conveying speed Vb is also set by estimating this dispersion.

In this embodiment mode, the sheet is detected by the photo-interrupter and the lever. However, if a sensor of a transmission type or a reflection type using an LED and able to directly detect the sheet is used, loss corresponding to the length of the lever is removed so that the sheet interval can be further reduced and productivity can be improved at the same image forming speed.

In the above embodiment mode, the speed increasing control from the resist roller pair 20 to the decelerating point is explained with respect to the early arrival and the delay of the sheet S at the resist roller pair 20. However, the conveying speed may be also controlled as follows.

For example, in the case of the sheet S such as film paper, etc. having high rigidity, there is a case in which it is necessary to convey the sheet S at low speed since the sheet S is easily jammed. There is a structure in which the conveying speed from the paper feed cassettes 3*a*, 3*b* to the resist roller pair 20 is changed in accordance with the physical property of the sheet S such as the material, thickness, etc. of the conveyed sheet S. In this case, the arriving time at the resist roller pair 20 is different in accordance with the conveying speed of the sheet S. Therefore, the speed increased between the resist roller pair 20 and the decelerating point is set in advance every sheet S of the different physical property, and the sheet S is conveyed that the speed according to this sheet S. In this case, it is also necessary to conform the sheet S to the image forming line E at the decelerating point, and the conveying speed is properly set in advance every sheet S in this way.

As explained above, in the image forming apparatus for performing the writing operation on the photosensitive drum 2*c* at a constant interval, the speed increasing control from the resist roller pair 20 to the decelerating point is performed with respect to the early arrival and the delay of the sheet S at the resist roller pair 20, and the difference in the conveying speed every sheet S. Thus, the efficiency (productivity per unit time) of the image formation can be improved by constantly setting the sheet interval at its minimum.

(Other Embodiment Modes)

The latent image can be formed with the start signal of the resist roller pair 20 as a reference by setting the speed control and the arrangement so as to satisfy the following condition, $$V2 \geqq V1 \times t9/(t9-t8) \quad (1),$$

and $$L/V1 < t3 \quad (2)$$

when the image forming speed is V1 the sheet conveying speed of the resist roller pair 20 at its high rotating speed time is V2, a hitting time of the sheet 3 against the resist roller pair 20 is t8, (the distance from the resist roller pair 20 to the position for setting the conveying speed of the sheet S to be equal to the image forming speed V1 by the resist roller pair 20)/(the image forming speed V1) is t9, the distance on the photosensitive drum 2*c* from the latent image forming position to the transfer position is L, and the sheet conveying time from the resist roller pair 20 to the transfer charger 2*g* is t3. Since there is no dispersion of the time (L/V1) from the latent image forming position to the transfer position, the small dispersion of the arrival of the sheet at the above resist roller pair 20 is dissolved and the positions of the sheet S and the image can be accurately conformed to each other. In this embodiment mode, since it is necessary to constantly set t3, V2 is a fixing value and latent image writing timing tw in the above embodiment mode is changed by the small dispersion amount. Further, similar to the above embodiment mode, it is important to narrow the sheet interval that the paper feed conveying control for restraining large dispersion after the paper feed is performed in advance. The latent image forming position is a position in which the laser beam from the laser light emitting portion 2*a* is irradiated onto the photosensitive drum 2*c*. The transfer position is a position in which the photosensitive drum 2*c* and the transfer charger 2*g* are opposed to each other.

Thus, it is possible to dissolve the delay of the time t8 for forming the loop and correcting the oblique movement by hitting the sheet S against the resist roller pair 20, and the loss of the starting up time of the stepping motor by performing the speed increase control. Accordingly, the sheet interval is constantly minimized and the image position can be accurately set.

In contrast to the above embodiment mode, no independent stepping motor may be arranged by arranging a one-way clutch locked in the conveying direction on the driving shaft of the conveying roller pair 22. After the sheet S is nipped and supported by the resist roller pair 20, the operation of the conveying roller pair 22 is turned off and the sheet S is pulled-in in an idle running direction of the one-way clutch by the resist roller pair 20. Thus, the sheet conveyance similar to that in the above embodiment mode can be performed by a simple construction.

Further, the present invention may be also applied to the sheet conveyer of a system in which a striking plate able to be selectively shunted at a position before the conveying roller at a position prior to the image forming section is arranged as the registration section of the present invention, and a sheet detecting sensor is arranged in the upper stream of the striking plate, and the operation of the conveying roller in the upper stream of the striking plate is stopped in predetermined timing from a detecting signal of the sheet detecting sensor, and the oblique movement is corrected by arranging the sheet tip in parallel with the striking plate, and the striking plate is shunted in synchronization with the image formed by the image forming section.

What is claimed is:

1. An image forming apparatus comprising:

an image forming section for forming a latent image on the basis of a signal outputted at a constant time interval, and forming the image on a sheet by developing the latent image;

a registration section arranged on the upstream side of said image forming section, and able to change a conveying speed for re-feeding the sheet after the sheet is stopped for a predetermined time; and a control section for starting the conveyance of the sheet by said registration section at a conveying speed higher than an image forming speed in said image forming section, and for controlling the conveying speed so as to be equal to said image forming speed at a decelerating position before a predetermined distance from said image forming section;

wherein said control section is able to set the conveying speed variously between said registration section and said decelerating position to change the conveying speed to the same speed as said image forming speed at said decelerating position.

2. An image forming apparatus according to claim 1, wherein said control section sets the conveying speed from said registration section up to at the decelerating position before the predetermined distance from the image forming section on the basis of an early arrival or delay of the sheet at said registration section.

3. An image forming apparatus according to claim 1, wherein said control section is able to change the conveying speed by said registration section from said registration section up to the decelerating position before the predetermined distance from the image forming section in accordance with the physical property of the sheet.

4. An image forming apparatus according to claim 1, wherein said registration section has a resist roller pair operated by a stepping motor, and said control section sets the conveying speed from said registration section up to the decelerating position before the predetermined distance from said image forming section by estimating a time required to start up said stepping motor.

5. An image forming apparatus according to claim 1, wherein an electromagnetic clutch is used in driving coupling of said registration section, and said control section sets the conveying speed from said registration section up to the decelerating position before the predetermined distance from said image forming section by estimating the dispersion of a coupling time of said electromagnetic clutch.

6. An image forming apparatus according to claim 1, further comprising:

a sheet support section for supporting the sheet supplied to said image forming section, a sheet feed section for feeding the sheet from said sheet support section, and a sheet conveying section for conveying the sheet fed from said sheet feed section up to said registration section;

wherein said control section temporarily stops the sheet fed by said sheet feed section by said sheet conveying section, conveys the sheet in predetermined timing where a speed faster than the image forming speed in said image forming section up to said registration section.

7. An image forming apparatus according to claim 1, wherein $V2 \geqq V1 \times t9/(t9-t8)$ and $L/V1 < +t3$ are set when the image forming speed is V1, the sheet conveying speed of said registration section at its high speed time is V2, a hitting time of the sheet against said registration section is t8, (the distance from said registration section to the position for setting the conveying speed of the sheet to be equal to the image forming speed by said registration section)/(the image forming speed V1) is t9, the distance on said image forming section from the latent image forming position to the transfer position is L, and the sheet conveying time from said registration section to the transfer position is t3.

8. An image forming apparatus comprising:

image forming means for forming a latent image at an image forming speed on the basis of a signal;

registration means arranged on an upstream side of said image forming means for re-feeding the sheet after the sheet is stopped for a predetermined time, wherein said signal for forming a latent image is outputted before the start of re-feeding the sheet by said registration means; and control means for starting conveyance of the sheet re-fed by said registration means at a speed which is higher than the image forming speed, and controlling the conveying speed so as to be equal to said image forming speed at a decelerating position before a predetermined distance from said image forming means, wherein said control means sets the conveying speed at various speeds according to a dispersion of the arrival time of the sheet in said registration means.

9. An image forming apparatus according to claim 8, wherein said control means starts the conveyance of the sheet after a loop is formed by said registration means, an amount of the loop is constant in spite of the dispersion of the arrival time of the sheet.

10. An image forming apparatus according to claim 9, wherein said control means controls said registration means so as to re-feed the sheet at a speed slower than a reference speed when the sheet arrives early at the registration means, and to re-feed the sheet faster than the reference speed when the sheet arrival at the registration means.

* * * * *

UNITED STATES PATENT AND TRADEMARK OFFICE

CERTIFICATE OF CORRECTION

PATENT NO. : 6,771,928 B2
DATED : August 3, 2004
INVENTOR(S) : Takashi Fujita

It is certified that error appears in the above-identified patent and that said Letters Patent is hereby corrected as shown below:

Column 3,
Line 45, “is a view” should read -- are views --.

Column 5,
Line 39, “be also” should read -- also be --.

Column 8,
Line 60, “be also” should read -- also be --.

Column 9,
Line 34, “3” should read -- S --.

Column 12,
Line 32, “arrival” should read -- arrives --.

Signed and Sealed this

Thirtieth Day of November, 2004

JON W. DUDAS
*Director of the United States Patent and Trademark Office*